United States Patent [19]

Schwehr

[11] 4,047,145

[45] Sept. 6, 1977

[54] PIVOTALLY ACTUATED SPEED CONTROL MEANS OF AN APPARATUS

[75] Inventor: Richard A. Schwehr, Mentor, Ohio

[73] Assignee: Towmotor Corporation, Mentor, Ohio

[21] Appl. No.: 682,814

[22] Filed: May 3, 1976

[51] Int. Cl.[2] ..... H01C 13/00

[52] U.S. Cl. ..... 338/67; 180/65 R; 200/61.89; 200/86.5; 338/153; 338/172; 338/198

[58] Field of Search ..... 338/50, 67, 172, 191, 338/198, 200, 153; 180/65 R, 77 R, DIG. 3; 214/78, 80; 200/61.89, 86.5; 74/478, 560, 561, 515; 318/305, 139, 257, 260, 263

[56] References Cited

U.S. PATENT DOCUMENTS

| | | | |
|---|---|---|---|
| 971,199 | 9/1910 | Janisch | 318/139 |
| 2,490,458 | 12/1949 | Feldhausen | 338/191 X |
| 3,100,860 | 8/1963 | Rosenthal | 180/DIG. 3 |
| 3,507,350 | 4/1970 | Boyajian | 180/65 R X |
| 3,818,293 | 6/1974 | Weed | 318/305 X |

*Primary Examiner*—C. L. Albritton
*Attorney, Agent, or Firm*—Frank L. Hart

[57] ABSTRACT

An apparatus having an electrical power source and an accelerating element has pivotally actuated control means connected to the accelerating element.

6 Claims, 3 Drawing Figures

PIVOTALLY ACTUATED SPEED CONTROL MEANS OF AN APPARATUS

BACKGROUND OF THE INVENTION

In the construction of apparatus, for example electrical lift trucks, a control means is connected to an accelerating element of the vehicle for varying the speed of the vehicle in response to movement of the accelerating element.

Heretofore utilized control means, for example Accelerator Switch 1C4485ACC manufactured by General Electric Co., Salem, Virginia, has a rotatable actuating bar connected to the accelerating element for actuating stop and bypass switches through cams positioned on the rotatable bar. Linkage means having a multiplicity of links connect the rotatable actuating bar to a potentiometer of the assembly for controlled movement of the potentiometer in response to movement of the accelerator.

Although these type control means generally functioned satisfactorily, it was decided that important advantages could be realized by constructing the control means with fewer moving parts. It was discovered that maintenance time and the effect of switch hysteresis could be reduced by the apparatus of this invention.

This invention therefore resides in an apparatus having a pivotally actuated control means for varying the speed of the apparatus.

DETAILED DESCRIPTION OF THE INVENTION

Figure 1:
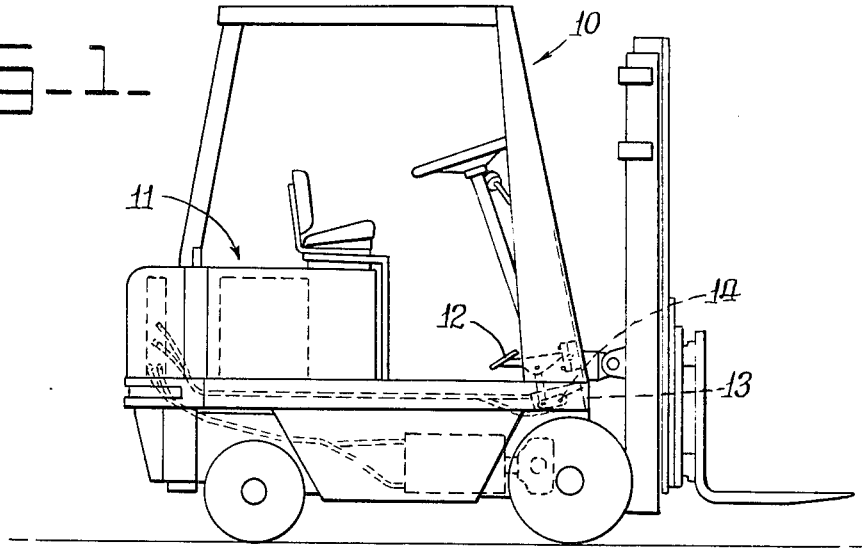
FIG. 1 is a diagrammatic side view of a vehicle having the apparatus of this invention.

Referring to FIG. 1, an apparatus, for example an electrically operated lift truck 10, has an electrical power source 11, an accelerating element 12, and a control means 13 connected to the accelerating element 12 by a rotatably movable shaft 14 for varying the speed of the vehicle 10 in response to movement of the accelerating element 12 by an operator. It should be understood that the accelerating element 12 can be hand or foot operated and the apparatus can be a vehicle 10 or other type structure.

Figure 3:
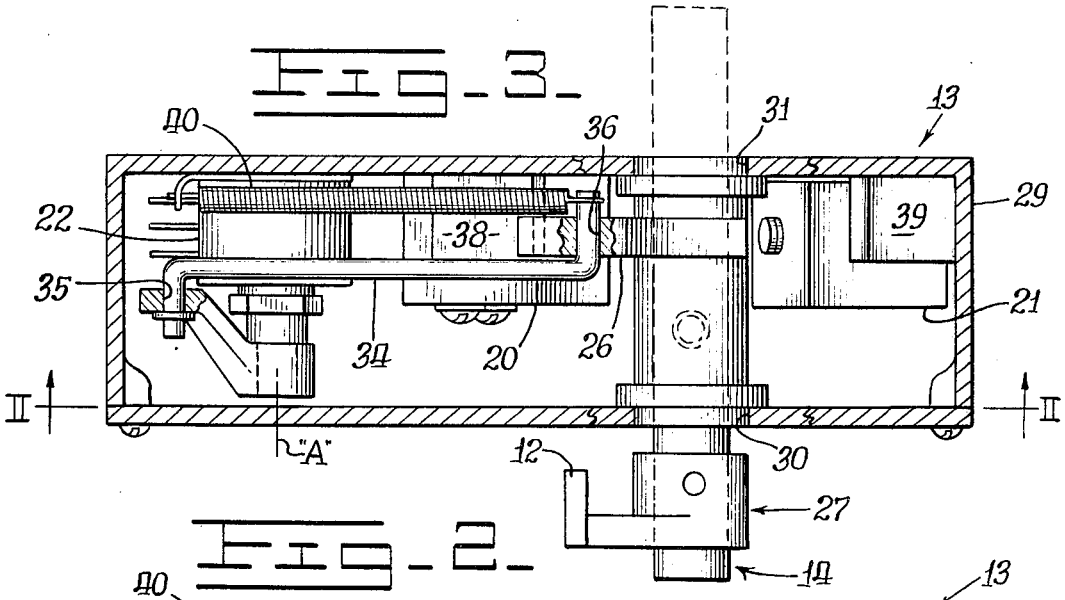
FIG. 3 is a diagrammatic top view of the apparatus of FIG. 2.
Figure 2:
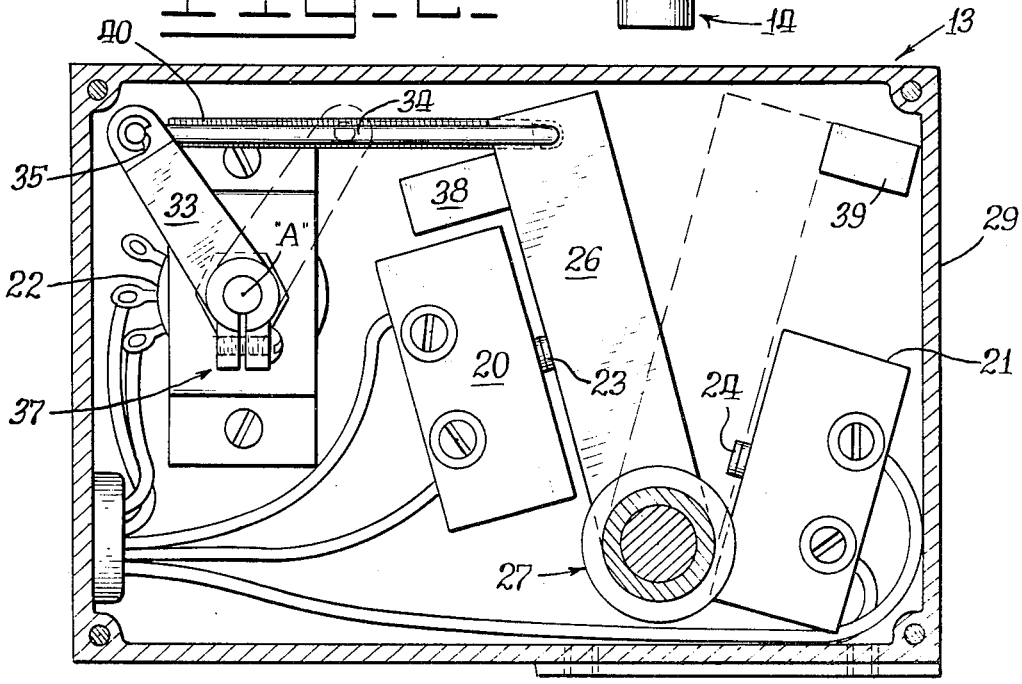
FIG. 2 is a diagrammatic side view in partial section of the apparatus of this invention.

Referring to FIGS. 2 and 3, the control means 13 has a start switch 20, a bypass switch 21, and a potentiometer 22. The switches 20, 21 each have actuating means 23, 24, such as a push button for example, for completing and breaking selected circuits of the control means 13. The switches 20, 21 and potentiometer 22 are associated with the accelerating element 12 and are controllable in response to movement of the accelerating element 12, as is further known in the art. In the embodiment of this invention, an actuating element 26 is positioned between the start switch 20 and the bypass switch 21 adjacent the actuating means 23, 24 of said switches 20, 21. The actuating element 26 is pivotally movable between a first position, shown by solid lines and a second position shown by broken lines.

At the first position, the actuating element 26 is spaced from the bypass switch 21 and in sufficient contact with the actuating means 23 of the start switch 20 to cause the actuating means 23 to be depressed. At this first position of the actuating element 26, the start switch 20 and the bypass switch 22 are open.

At the second position, the actuating element 26 is spaced from the start switch 20 and in sufficient contact with the actuating means 24 of the bypass switch 21 to cause the actuating means 24 to be depressed. At this second position of the actuating element 26, the start switch 20 and the bypass switch 22 are closed.

At intermediate positions of the actuating element 26, the start switch 20 is closed and the bypass switch 21 is open.

Means 27, such as for example a rotatable shaft 41 and associated linkage, is provided for connecting the actuating element 26 to the accelerating element 12 for pivotally moving the actuating bar 26 in response to movement of the accelerating 12. In a preferred embodiment, the control means 13 is enclosed in a housing 29 which has adjacent openings 30, 31 through opposed walls thereof. The rotatable shaft of means 27 is extendable through opening 30, opening 31, or both, thereby providing for positioning of the control means 13 on either side of the accelerating element 12.

The potentiometer 22 has a pivotally movable control element 33 for changing the resistance of the potentiometer 22. A unitary tie bar 34 is connected at one end to the pivotally movable control element 33 of the potentiometer 22 and at the other end to the actuating element 26 for controllably moving the control element 33 in response to movement of the tie bar 34 by the actuating element 26.

Ends of the tie bar 34 extend through openings 35, 36 of the respective control element 33 and actuating element 26. These openings 33, 26 are positioned at sufficient locations relative one to the other and to the length and positions of elements 26, 33 for movement of the potentiometer control element 33 preselected values in response to selected movements of the actuating element 26. These openings 35, 36 are also positioned for maintaining the potentiometer control element 33 at a maximum resistance position at the first position of the actuating element 26, and at a minimum resistance position at the second position of said element 26.

Further control over the relative movements of the elements is provided by clamp means 37 for releasably connecting the control element 33 to the associated control equipment of the potentiometer 22 for controllably positioning the control element 33 at a multiplicity of positions about an axis A of the potentiometer 22. The clamp means 37 therefore provides for "fine tuning" the apparatus 10.

Stop elements 38, 39 can be positioned adjacent respective switches 20, 21 for limiting the movement of the actuating element 26 and protecting the switches 20, 21 from excessive forces subjected thereupon in response to movement of the accelerating element 12. Biasing means 40 can be associated with the actuating element 26 for biasing said element 26 toward the first position. By this construction, if there is a malfunction of associated elements, the actuating element 26 will be moved by the biasing means 40 to the first position at which the vehicle, for example, is stopped.

In the operation of this invention, the accelerating element 12 and actuating element 26 are at the first position in the unenergized condition, the switches 20, 21 are open and the potentiometer is at a maximum resistance position. Movement of the accelerating element 12 and the actuating element 26 in response thereto toward the second position causes switch 20 to close, the resistance of the potentiometer 22 to be controllably decreased in response to the amount of movement of the accelerating element 12, and the speed of the vehicle 10 to increase.

At the second position of the accelerating element 12 and the movement-following actuator element 26, switches 20, 21 are closed and the potentiometer is at the minimum resistance position for supplying full power to the apparatus 10.

By so constructing the apparatus of this invention, the number of moving parts is reduced, maintenance is reduced, switch hysteresis effect is reduced, adjustment is quicker and more accurate, and the control means is more versatile and less expensive.

Other aspects, objects, and advantages of this invention can be obtained from a study of the drawings, the disclosure, and the appended claims.

What is claimed is:

1. In apparatus having a power source, an accelerating element, and control means connected to the accelerating element for varying the speed of the apparatus in response to movement of the accelerating element, said control means having a start switch having an actuating means, a bypass switch having an actuating means, and a potentiometer having a pivotally movable control element, each of said switches and potentiometer being associated with the accelerating element and controllable in response to movement of the accelerating element, the improvement comprising:

an actuating element being pivotally movable between a first position at which the actuating element is spaced from the bypass switch, in contact with the actuating means of the start switch, and the actuating means of the start and bypass switches are open and a second position at which the actuating element is spaced from the start switch, in contact with the actuating means of the bypass switch, and the actuating means of the start and bypass switches are closed, said actuating means of the start switch being at the closed position and said actuating means of the bypass switch being at the open position in response to the actuating element being at intermediate positions;

means for connecting the actuating element to the accelerating element, said actuating element being pivotally movable in response to movement of the accelerating element; and a tie bar having one end connected to the pivotally movable control element of the potentiometer and the other end connected to the actuating element at locations sufficient for controllably moving the control element and controlling the potentiometer in response to movement of the tie bar by the actuating element.

2. Apparatus, as set forth in claim 1, wherein one end of the tie bar extends through an opening of the potentiometer control element and the other end of said bar extends through an opening of the actuating element, said openings being positioned at sufficient locations relative one to the other for movement of the potentiometer control element preselected values in response to selected movements of the actuating element.

3. Apparatus, as set forth in claim 1, wherein the tie bar is connected to the potentiometer control element and the actuating element and said elements are at locations sufficient for maintaining the potentiometer control element at a maximum resistance position of the potentiometer at the first position of the actuating element and at a minimum resistance position at the second position of the actuating element.

4. Apparatus, as set forth in claim 1, wherein the control element includes:

clamp means for releasably connecting the control element to the potentiometer for controllably positioning the control element at a multiplicity of positions about an axis A of the potentiometer.

5. Apparatus, as set forth in claim 1, wherein the control means includes a housing having first and second adjacent openings; and the connecting means of the actuating element includes a rotatable shaft extendable through at least one of the first and second housing openings.

6. Apparatus, as set forth in claim 1, including means for biasing the actuating element toward the first position.

* * * * *